US009714599B2

(12) United States Patent
Takahashi et al.

(10) Patent No.: US 9,714,599 B2
(45) Date of Patent: Jul. 25, 2017

(54) ENGINE-DRIVEN GENERATOR

(71) Applicant: HONDA MOTOR CO., LTD., Tokyo (JP)

(72) Inventors: Yuki Takahashi, Wako (JP); Takuo Kase, Wako (JP); Kazuki Shimozono, Wako (JP); Kiyomi Yanai, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/018,464

(22) Filed: Feb. 8, 2016

(65) Prior Publication Data

US 2016/0281576 A1 Sep. 29, 2016

(30) Foreign Application Priority Data

Mar. 26, 2015 (JP) ..... 2015-065004

(51) Int. Cl.

| | |
|---|---|
| ***F01N 3/00*** | (2006.01) |
| ***F01N 13/00*** | (2010.01) |
| ***F01P 1/06*** | (2006.01) |
| ***F02B 63/04*** | (2006.01) |
| ***F01N 1/00*** | (2006.01) |

(52) U.S. Cl.

CPC ..... *F01N 13/002* (2013.01); *F01N 1/00* (2013.01); *F01P 1/06* (2013.01); *F02B 63/04* (2013.01); *F02B 63/044* (2013.01); *F01N 2260/022* (2013.01); *F01N 2260/20* (2013.01); *F01N 2590/10* (2013.01)

(58) Field of Classification Search

CPC ..... F01N 13/002; F01N 3/055; F01N 1/00; F01N 2260/022; F01N 2260/20; F01N 2590/10; F01P 1/06; F02B 63/04; F02B 63/044

See application file for complete search history.

(56) References Cited

U.S. PATENT DOCUMENTS 6,084,313 A * 7/2000 Frank ..... F02B 63/04 123/2
6,091,160 A * 7/2000 Kouchi ..... F02B 63/04 290/1 A
6,489,690 B1 12/2002 Hatsugai et al.

FOREIGN PATENT DOCUMENTS

| | | |
|---|---|---|
| JP | H06-004023 | 2/1994 |
| JP | 2000-328957 | 11/2000 |
| WO | 2008/032414 | 3/2008 |

OTHER PUBLICATIONS

Japanese Office Action dated May 13, 2016 with partial English Translation, 8 pages.

* cited by examiner

*Primary Examiner* — Phutthiwat Wongwian
*Assistant Examiner* — Diem Tran
(74) *Attorney, Agent, or Firm* — Rankin, Hill & Clark LLP

(57) ABSTRACT

An engine-driven generator includes an exhaust muffler disposed adjacent to a lateral side of a cylinder block, a fan cover having an air outlet arranged to face the exhaust muffler and the cylinder block, the fan cover being configured to guide cooling air from a cooling fan directly to the air outlet, and an opening area-adjustment member provided on a muffler blow-off port of the air outlet for adjusting an opening area of the muffler blow-off port.

2 Claims, 9 Drawing Sheets

ENGINE-DRIVEN GENERATOR

FIELD OF THE INVENTION

The present invention relates to an engine-driven generator including a generator unit driven by an engine, and an exhaust muffler provided in the vicinity of a cylinder block of the engine.

BACKGROUND OF THE INVENTION

Engine-driven generators are known, which includes a cooling fan disposed on one side (hereinafter referred to as "front side") of an engine and an exhaust muffler disposed on an opposite side (hereinafter referred to as "rear side") of the engine such that the engine and the exhaust muffler are cooled by cooling air fed from the cooling fan. More specifically, the engine (more particularly, a cylinder block thereof) is cooled by the cooling air fed from the cooling fan, and the exhaust muffler is cooled by the cooling air after having cooled the engine. A typical example of such known engine-driven generators is disclosed in WO2008/032414.

In the engine-driven generator disclosed in WO2008/032414, the cooling fan is provided on the front side of the engine and the exhaust muffler is provided on the rear side of the engine. With this arrangement, the exhaust muffler projects rearwardly from the engine and the thus projecting exhaust muffler constitutes a hindrance to downsizing of the engine-driven generator.

As a means for performing downsizing of the engine-driven generator, it may be considered that the exhaust muffler is disposed on a lateral side of the engine in such a manner as to extend in a front-and-rear direction of the engine. However, if the exhaust muffler is disposed on the lateral side of the engine, a cylinder block of the engine and the exhaust muffler will be arranged in lateral juxtaposition. With this arrangement, it is difficult to perform a cooling operation in which the cylinder block is cooled by cooling air and the exhaust muffler is cooled by the cooling air after having cooled the cylinder block in the same manner as done for the engine-driven generator disclosed in WO2008/032414. To deal with this difficulty, some creative ideas are required to perform proper cooling of both of the cylinder block and the exhaust muffler concurrently by cooling air fed by the cooling fan.

It is therefore an object of the present invention to provide an engine-driven generator which is capable of achieving down-sizing of the engine-driven generator while securing proper cooling of a cylinder block and an exhaust muffler.

SUMMARY OF THE INVENTION

According to the present invention, there is provided an engine-driven generator comprising: a vertical engine having a cylinder disposed substantially vertically; a generator unit provided on a side of the engine from which a crankshaft of the engine projects outwardly; a cooling fan disposed on a side of the generator unit opposite to the engine for cooling the engine and the generator unit; an exhaust muffler included in the engine and disposed adjacent to a lateral side of the cylinder extending along the crankshaft; a fan cover having an air outlet arranged to face the exhaust muffler and the cylinder, the fan cover being configured to guide cooling air from the cooling fan directly to the air outlet; and an opening area-adjusting member provided on a muffler blow-off port of the air outlet for adjusting an opening area of the muffler blow-off port.

With this arrangement, the cylinder of the engine (i.e., a cylinder block) is disposed substantially vertically, and the exhaust muffler is disposed adjacent to the lateral side of the cylinder block. The lateral side of the cylinder block is located laterally inward as compared to a crankcase of the engine so that there is a space formed at lateral side of the cylinder block. When attaching to the lateral side of the cylinder block, the exhaust muffler is allowed to be disposed in the space formed at the lateral side of the cylinder block. Installation of the exhaust muffler using the space at the lateral side of the cylinder block enables substantial down-sizing of the engine-driven generator.

The air outlet of the fan cover is arranged to face the exhaust muffler and the cylinder (more specifically, the cylinder block) so that cooling air fed from the cooling fan is directly guided to the air outlet via the fan cover. The cooling air having low temperature can thus be guided to the exhaust muffler and the cylinder block. Furthermore, the muffler blow-off port of the fan cover is provided with the opening area-adjusting member so that the opening area of the muffler blow-off port can be adjusted by the opening area-adjusting member. A volume of cooling air to be guided to the exhaust muffler and a volume of cooling air to be guided to the cylinder block can be properly distributed by the opening area-adjusting member. The cylinder block and the exhaust muffler can be properly cooled by the cooling air fed from the cooling fan. Additional to downsizing of the engine-driven generator, proper cooling of the cylinder block and the exhaust muffler by the cooling air from the cooling fan can thus be secured.

Preferably, the opening area-adjusting member comprises a plurality of openings variable in number and configuration to adjust the opening area of the muffler blow-off port. By merely changing the configuration of the openings, the opening area of the muffler blow-off port can be adjusted.

The engine-driven generator may further comprise: a muffler protector for protecting the exhaust muffler; and an air guide space defined between the muffler protector and the exhaust muffler and held in fluid communication with the muffler blow-off port. With this arrangement, the cooling air guided from the muffler blow-off port into the air guide space is further guided to flow downstream along the air guide space. The cooling air, as it flows along the air guide space, comes in contact with a large area of the exhaust muffler and hence is able to cool the exhaust muffler with increased efficiency.

DETAILED DESCRIPTION OF THE PREFERRED EMBODIMENT

Figure 1:
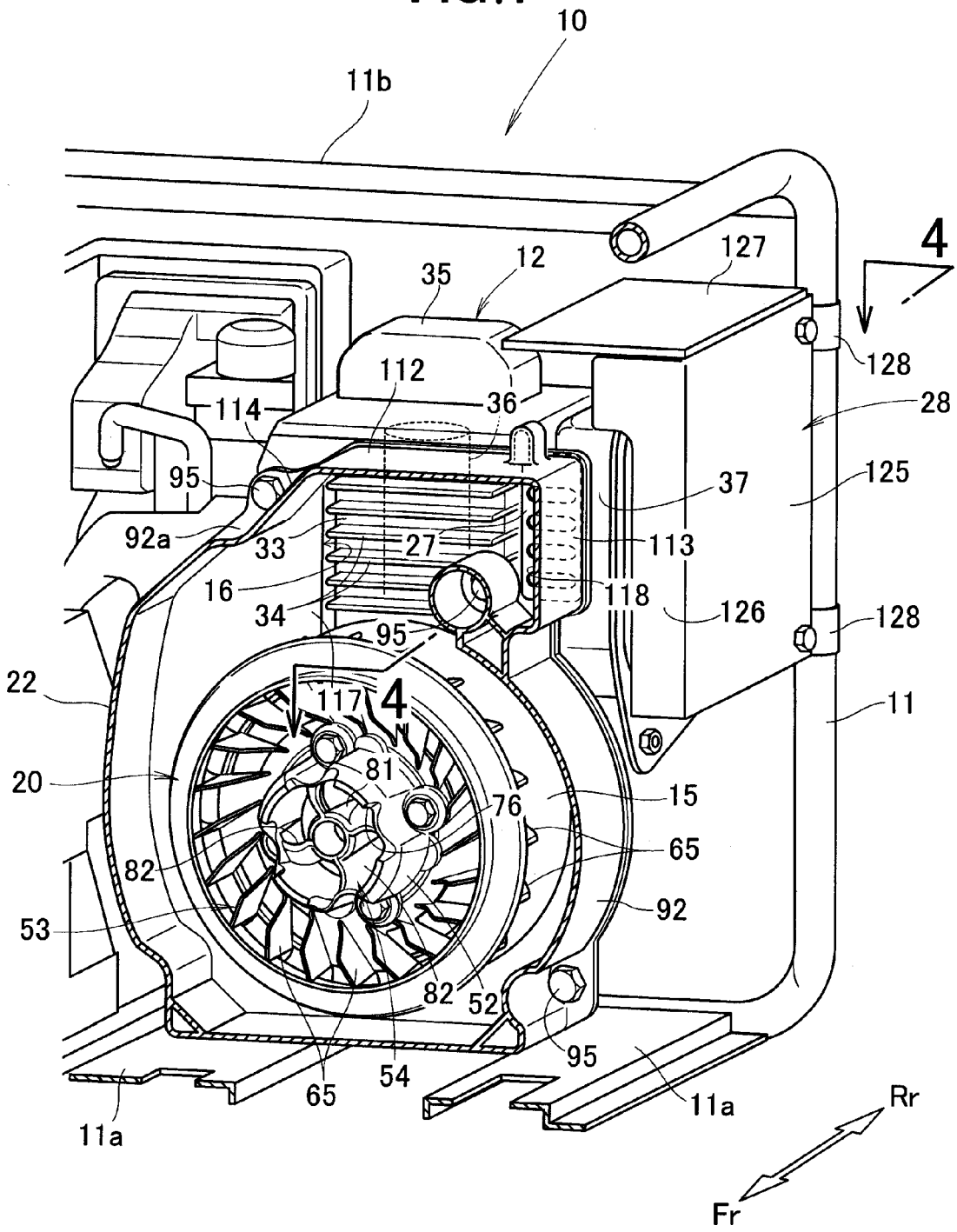
FIG. 1 is a perspective view, with part cutaway for clarity, of an engine-driven generator according to an embodiment of the present invention.

A certain preferred structural embodiment of the present invention will be described in greater details below, by way of example only, with reference to the accompanying sheets of drawings. In the drawings, "Fr" and "Rr" are used to refer to a front side or recoil cover side, and a rear side or engine side, respectively.

Figure 2:
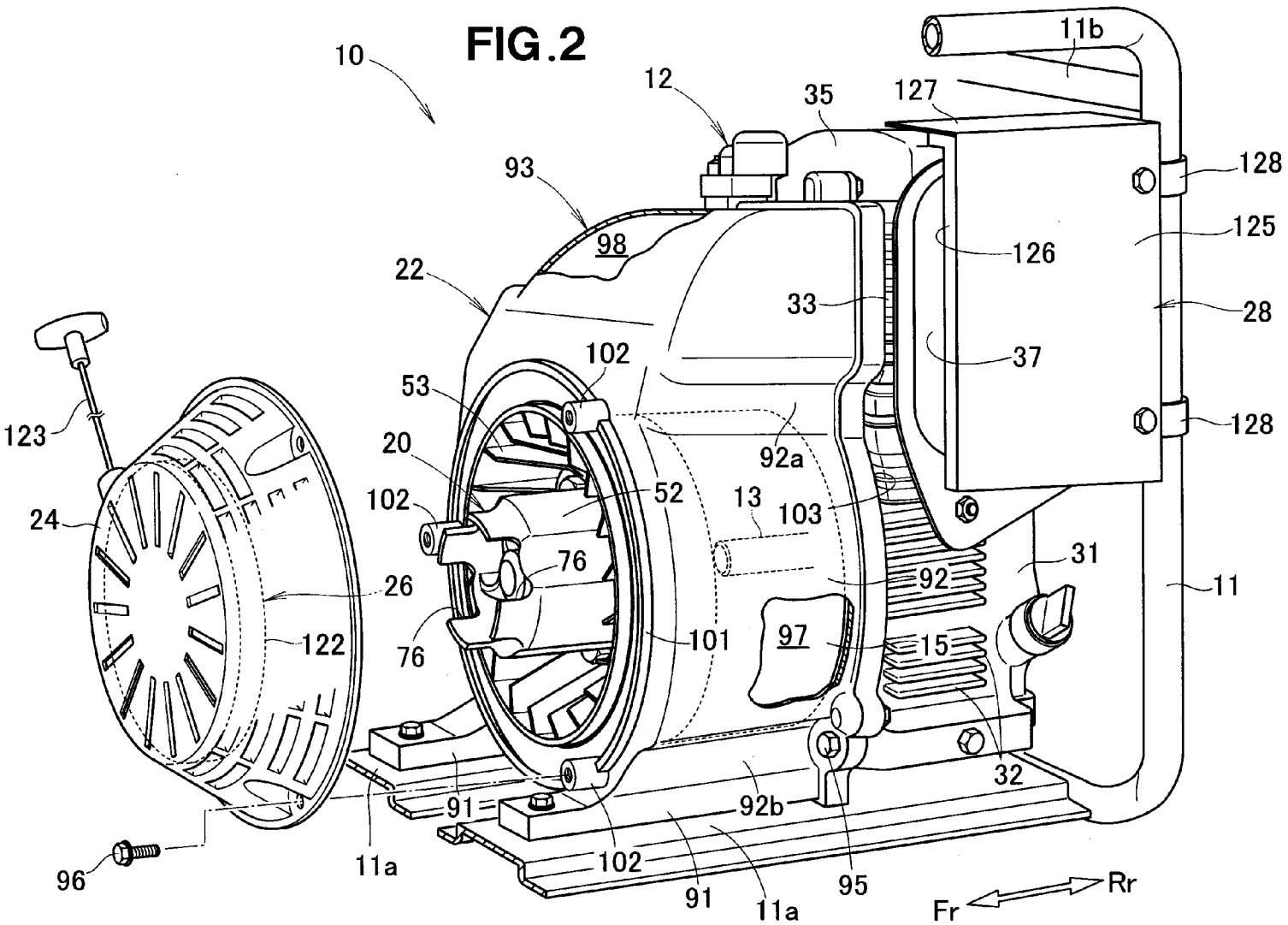
FIG. 2 is an exploded perspective view of the engine-driven generator.

As shown in FIGS. 1 and 2, an engine-driven generator 10 embodying the present invention includes an engine 12 mounted on a bottom 11*a* of a frame 11, a generator unit 15 provided in front of the engine 12, a cooling fan 20 connected to a drive shaft of the generator unit 15, a fan cover 22 covering the cooling fan 20 and the generator unit 15.

The engine-driven generator 10 further includes a recoil cover 24 attached to the fan cover 22, a recoil starter 26 attached to the recoil cover 24, an opening area-adjusting member 27 attached to a rear end portion of the fan cover 22, and a muffler protector 28 for protecting the exhaust muffler 37.

The frame 11 has a substantially rectangular body shape formed by pipe members extending along the engine 12, the exhaust muffler 37 and the cooling fan 20. The engine 12, the exhaust muffler 37 and the cooling fan 20 are held in a stable state by the frame 11. The frame 11 has a grip portion 11*b* adapted to be gripped by a human operator so that the engine-driven generator 10 is made portable. The engine 12 is mounted on the bottom 11*a* of the frame 11.

The engine 12 includes a crankcase (lower part of a barrel) 31 on which a crankshaft 13 is rotatably supported, a cylinder block (upper part of the barrel) 33 formed on an upper part of the crankcase 31, a head cover 35 covering an upper end portion of the cylinder block 33, and the exhaust muffler 37 disposed adjacent to one lateral side 33*a* of the cylinder block 33. The crankcase 31 has a series of cooling fins 32 formed on an outer surface thereof. Similarly, the cylinder block 33 has a series of cooling fins 34 formed on an outer surface thereof.

The cylinder block 33 has a cylinder 36 formed therein. The cylinder 36 and the cylinder block 33 are disposed substantially vertically so that the engine 12 is a so-called "vertical engine". The exhaust muffler 37 is located on a lateral side of the engine 12 (more concretely, the lateral side 33*a* of the cylinder block 33). Because of the cylinder 36 and the cylinder block 33 disposed substantially vertically, a width dimension of the engine 12 can be reduced.

Figure 3:
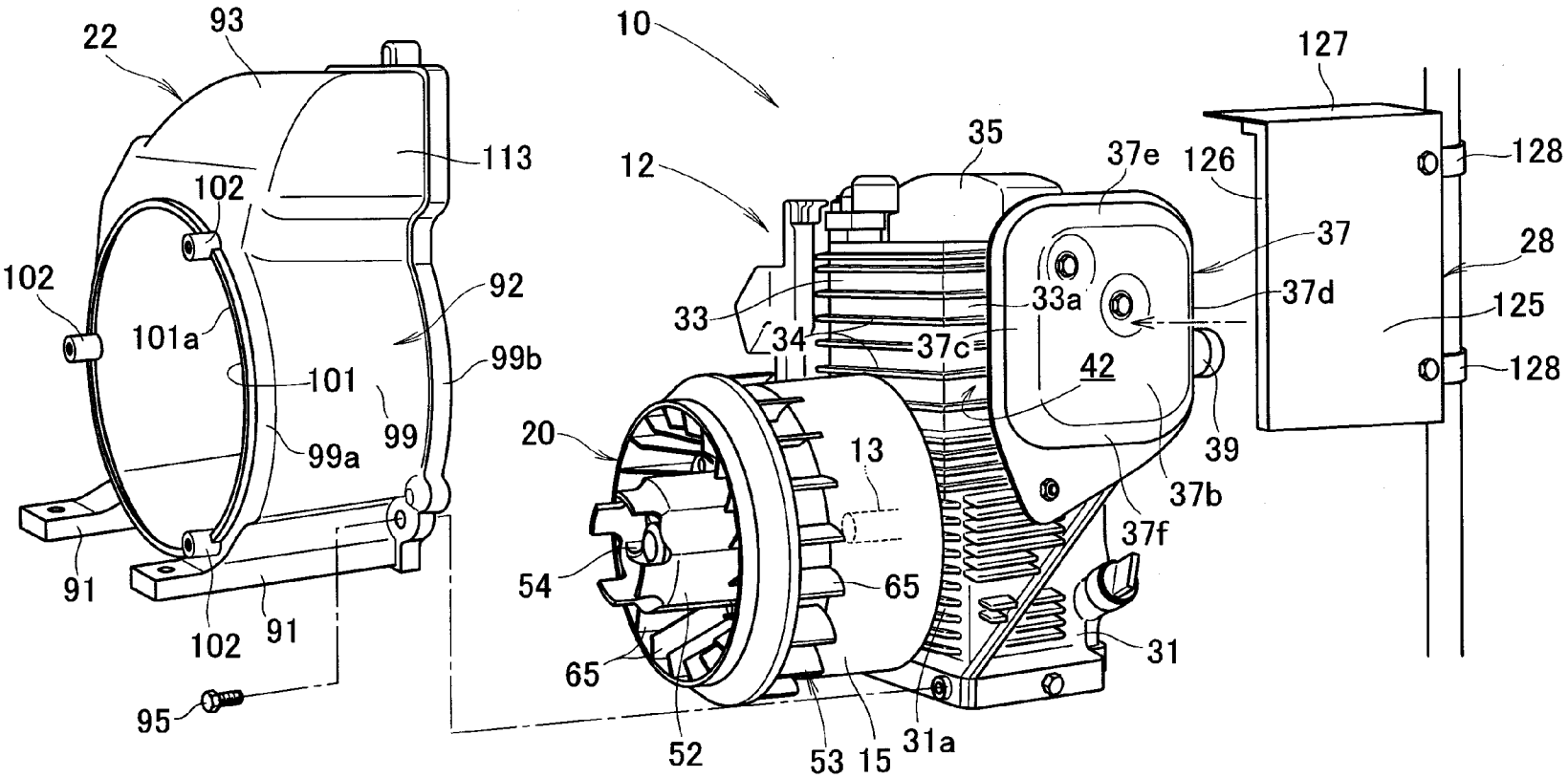
FIG. 3 is an exploded perspective view of the engine-driven generator shown in FIG. 2 with a fan cover and a muffler protector removed.
Figure 4:
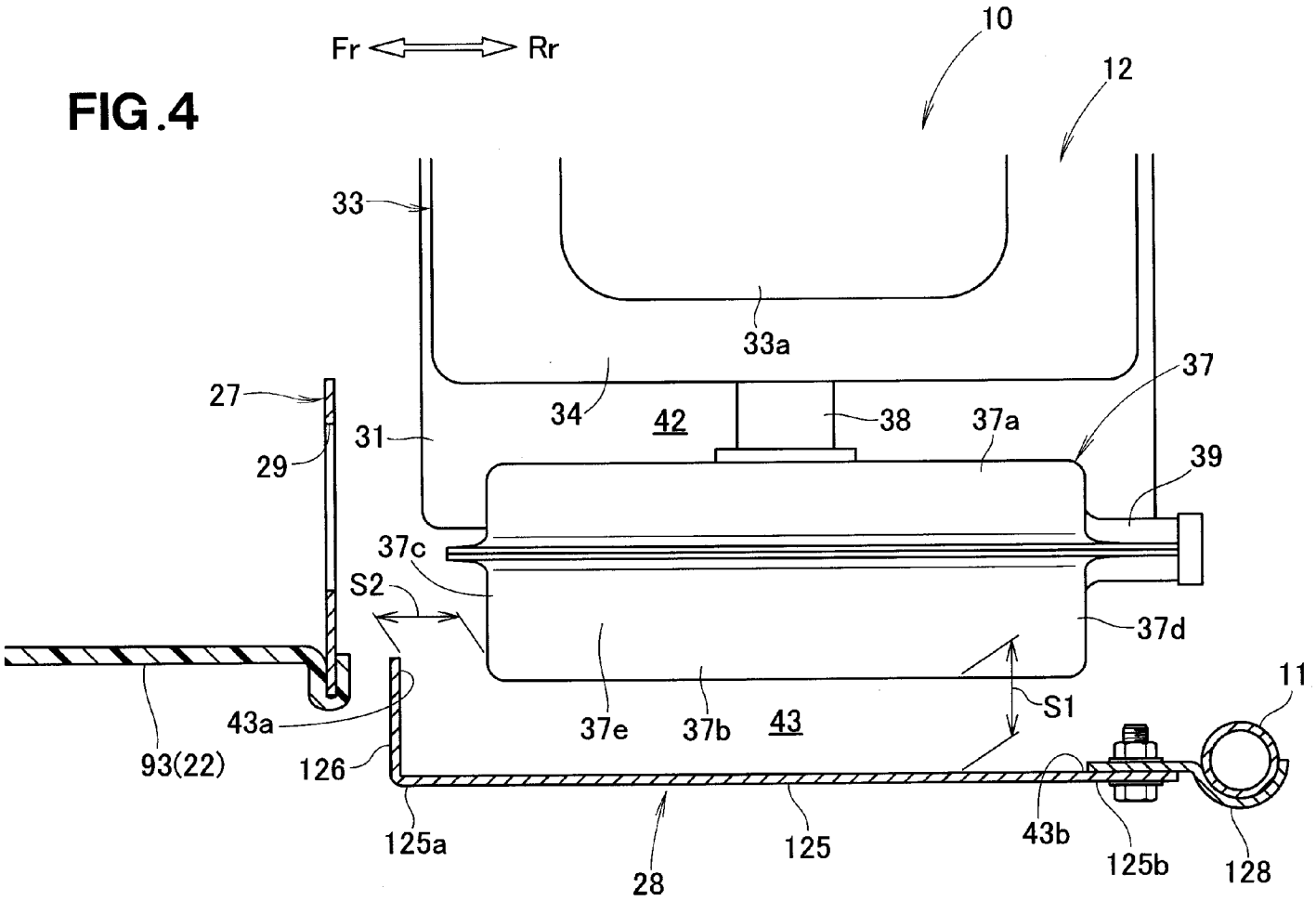
FIG. 4 is a cross-sectional view taken along the line 4-4 of FIG. 1.

As shown in FIGS. 3 and 4, the exhaust muffler 37 is disposed adjacent to the lateral side of the cylinder block 33 extending along the crankshaft 13. The exhaust muffler 37 is connected to a combustion chamber via an exhaust tube 38. The exhaust muffler 37 includes an inner wall 37*a* adjacent to the lateral side 33*a* of the cylinder block 33, an outer wall 37*b* facing in a laterally outward direction of the exhaust muffler 37, and a peripheral wall closing a space defined between the inner wall 37*a* and the outer wall 37*b*, the peripheral wall including a front wall 37*c*, a rear wall 37*d*, a top wall 37*e*, and a bottom wall 37*f*.

The inner wall 37*a*, the outer wall 37*b*, the front wall 37*c*, the rear wall 37*d*, the top wall 37*e*, and the bottom wall 37*f* together form the exhaust muffler 37 into a substantially rectangular body shape. Exhaust gas is introduced from the combustion chamber of the engine 12 through the exhaust tube 38 into the interior of the exhaust muffler 37. The exhaust gas thus introduced into the interior of the exhaust muffler 37 is discharged from an exhaust pipe 38 to the outside.

As discussed above, the cylinder block 33 of the engine 12 is disposed substantially vertically and the exhaust muffler 37 is disposed adjacent to the lateral side 33*a* of the cylinder block 33. The lateral side 33*a* of the cylinder block 33 is located inwardly as compared to the crank case 31, so that a space 42 is formed at the side of the lateral side 33*a* of the cylinder block 33.

This arrangement allows the exhaust muffler 37 to be mounted on the side of the lateral side 33 of the cylinder block 33 by using the space 42 formed at the side of the lateral side 33 of the cylinder block 33. Since the cylinder 36 and the cylinder block 33 of the engine 12 are disposed substantially vertically, the width dimension of the engine 12 can be reduced. By thus arranging the exhaust muffler 37 with the use of the space 42 formed at the side of the lateral side 33*a* of the cylinder block 33 of the engine 12, size reduction of the engine-driven generator 10 is possible.

The crankshaft 13 projects forward from the engine 12, and the generator unit 15 is provided on that side of the engine 12 from which the crankshaft 13 projects. The generator unit 15 includes a stator and a rotor received inside the fan cover 22 with the rotor connected to the drive shaft of the generator unit 15. The drive shaft of the generator unit 15 is connected to the crankshaft 13 of the engine 12. By rotating the drive shaft by the crankshaft 13, the rotor rotates together with the drive shaft so that an electric voltage is supplied from the generator unit 15. The drive shaft of the generator unit 15 is connected to the cooling fan 20.

As shown in FIGS. 1 and 3, the cooling fan 20 is disposed on a front side of the generator unit 15 (which is a side of the generator unit 15 opposite to the engine 12). The cooling fan 20 is provided with a forwardly protruding starter pulley 52, a centrifugal fan 53 formed on an outer side of an outer circumference of the starter pulley 52, and a diagonal-flow fan 54 formed on an inner side of the outer circumference of the starter pulley 52.

The centrifugal fan 53 has a plurality of centrifugal fins 65 extending substantially radially. When rotating, the centrifugal fan 53 is able to forcibly feed cooling air by the centrifugal fins 65 toward a radial outward direction of the cooling fan 20. The starter pulley 52 is formed into a substantially cylindrical shape projecting forwardly along an axis of the cooling fan 20. At a front end thereof, the starter pulley 52 has a plurality of engagement portions 76. The engagement portions 76 are in the shape of grooves so that a locking prong of the recoil starter (FIG. 2) is lockingly engageable with the engagement portions 76.

When the locking pawl of the recoil starter 26 comes into locking engagement with the engagement portions 76, rotation of the recoil starter 26 is transmitted via the locking pawl to the starter pulley 52. With the rotation of the recoil starter 26 thus transmitted to the starter pulley 52, the starter pulley 52 starts rotating together with the recoil starter 26. The diagonal-flow fan 54 is formed integrally with an inner circumferential surface of the starter pulley 52.

The diagonal-flow fan 54 has a plurality of diagonal-flow fins 82 extending substantially radially outward from an outer circumference of a fan shaft portion 81. The fan shaft portion 81 is disposed coaxially with the starter pulley 52 inside the starter pulley 52. The fan shaft portion 81 and the starter pulley 52 are connected together via the diagonal-flow fins 82. When rotating, the diagonal-flow fan 54 is able to forcibly feed cooling air by the diagonal-flow fins 82 in a direction diagonal to the axis of the cooling fan 20. By the cooling air fed from the centrifugal fan 53 and the cooling air fed from the diagonal-flow fan 54, the cylinder block 33 (i.e., the engine 12) and the generator unit 15 are cooled.

As shown in FIG. 2, the cooling fan 20 and the generator unit 15 are covered by the fan cover 22. In this condition, the fan cover 22 is attached to a front part of the engine 12 by a plurality of bolts 95. The recoil cover 24 is attached to a front side of a front end opening 101 of a cover part 92 of the fan cover 22. More specifically, the recoil cover 24 is attached to a plurality of attachment bosses 102 of the front end opening 101 by a plurality of bolts 96. The recoil starter 26 is mounted on a rear surface side of the recoil cover 24.

The recoil starter 26 includes a recoil pulley 122 rotatably supported on the rear surface side of the recoil cover 24, a cable 123 wound on the recoil pulley 122, and the locking pawl lockingly engageable with the engagement portions 76 of the starter pulley 52.

When the cable 123 of the recoil starter 26 is pulled by a human operator, the recoil pulley 122 is rotated. Rotation of the recoil pulley 122 causes the locking pawl of the recoil pulley 122 to come into engagement with the engagement portions 76 of the starter pulley 52 whereupon the starter pulley 52 begins to rotate. Rotation of the starter pulley 52 is transmitted via the drive shaft of the generator unit 15 to the crankshaft 13, and upon rotation of the crankshaft 13, the engine 12 starts running. After start of the engine 12, rotation of the crankshaft 13 is transmitted to the drive shaft and the starter pulley 52. Rotation of the starter pulley 52 causes the locking pawl of the recoil pulley 122 to be disengaged from the engagement portions 76 of the starter pulley.

By being driven by the engine 12, the drive shaft of the generator unit 15 is rotating. Rotation of the drive shaft causes the rotor of the generator unit 15 to rotate, thereby generating an electric voltage from the generator unit 15. On the other hand, rotation of the starter pulley 52 by the drive shaft causes the cooling fan 20 to rotate. Upon rotation of the cooling fan 20, cooling air is fed from the cooling fan 20 toward the generator unit 15 and the engine 12 to cool them.

The fan cover 22 includes leg parts 91, the cover part 92 formed integrally with the leg parts 91 into a substantially cylindrical shape, and a shroud part 93 formed at an upper portion 92*a* of the cover part 92. The cover part 92 has a lower portion 92*b* connected to the leg parts 91 and formed into the substantially cylindrical shape so as to cover the cooling fan 20, and the generator unit 15. The cover part 92 has an internal space 97 in which the cooling fan 20 and the generator unit 15 are accommodated.

As shown in FIGS. 3 and 4, the cover part 92 includes a peripheral wall 99 for covering the cooling fan 20 and the generator unit 15, the front end opening 101 formed at a front end 99*a* of the peripheral wall 99, the attachment bosses 102 formed at regular intervals along the front end opening 101, and a rear end opening 103 formed at a rear end 99*b* of the peripheral wall 99. The rear end opening 103 opens to locate adjacent to a front surface 31*a* of the crankcase 31. The front end opening 101 is disposed concentrically with the cooling fan 20 and formed to be larger in size in a radial outward direction than the cooling fan 20. The cooling fan 20 (also see FIG. 2) can be fitted with the front end opening 101.

The front end opening 101 of the cover part 92 has a circumferential edge 101*a* along which the attachment bosses 102 are formed at regular intervals. The attachment bosses 102 project forwardly from the circumferential edge 101*a*, and the recoil cover 24 (see FIG. 2) is attached to the attachment bosses 102. With the recoil cover 24 thus attached to the attachment bosses 102, the recoil cover 24 is located forwardly of the front end opening 101. The shroud part 93 formed at the upper portion 92*a* of the cover part 92 is configured to extend rearward from an upper part of the front end opening 101.

As shown in FIG. 2, the shroud part 93 is formed to extend from the front end opening 101 to the rear end opening 103 of the cover part 92 at the upper portion 92*a* of the cover part 93. With the shroud part 93 thus arranged, cooling air fed from the cooling fan 20 is guided from the front end opening 101 into the shroud part 93 and subsequently guided from the shroud part 93 to the cylinder block 33 and the exhaust muffler 37.

Figure 5:
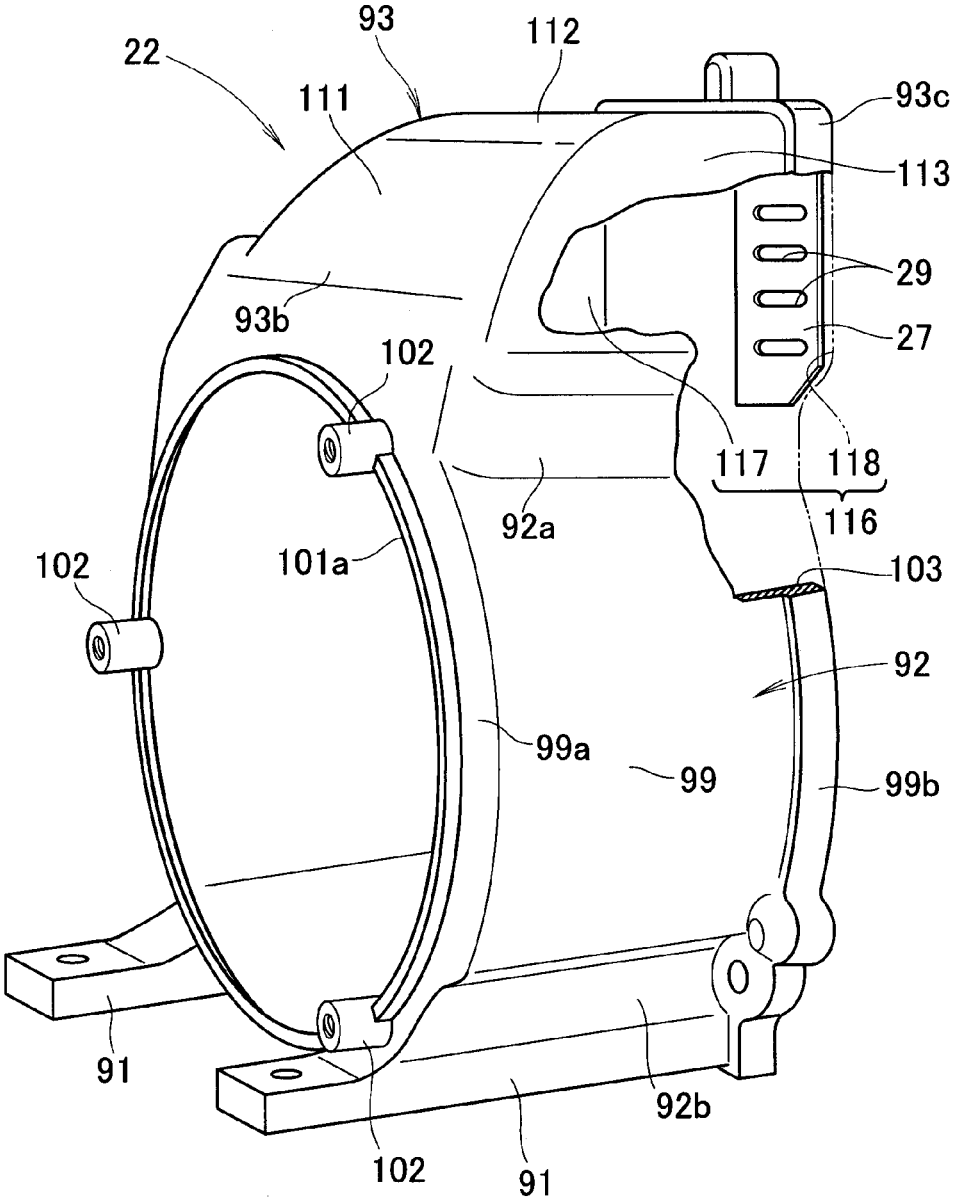
FIG. 5 is a perspective view of a fan cover shown in FIG. 3.

As shown in FIG. 5, the shroud part 93 includes a front wall 111, a top wall 112, a first lateral side wall 113, a second lateral side wall 114 (FIG. 1) opposite to the first lateral side wall 113, and an air outlet 116. The front wall 111 extends rearward from an upper part of the front end opening 101 in such a manner as to rise in a curved configuration. The top wall 112 extends substantially horizontally from a rear end of the front wall 111 to an upper part of the rear end opening 103. The first lateral side wall 113 extends vertically downward from one side edges of the front wall 111 and the top wall 112 to the upper portion 92*a* of the cover part 92. The second lateral side wall 114 extends vertically downward from the other side edges of the front wall 11 and the top wall 11*a* to the upper portion 92*a* of the cover part 92.

The front wall 111, the first lateral side wall 113 and the second lateral side wall 114 together form a generally U-shaped cross section of the shroud part 93. Similarly, the top wall 112, the first lateral side wall 113 and the second lateral side wall 114 together form a generally U-shaped cross section of the shroud part 93. The shroud part 93 is therefore formed into a generally U-shape in cross section from a front end 93*b* to a rear end 93*c* of the shroud part 93 (see also FIG. 6).

Figure 6:
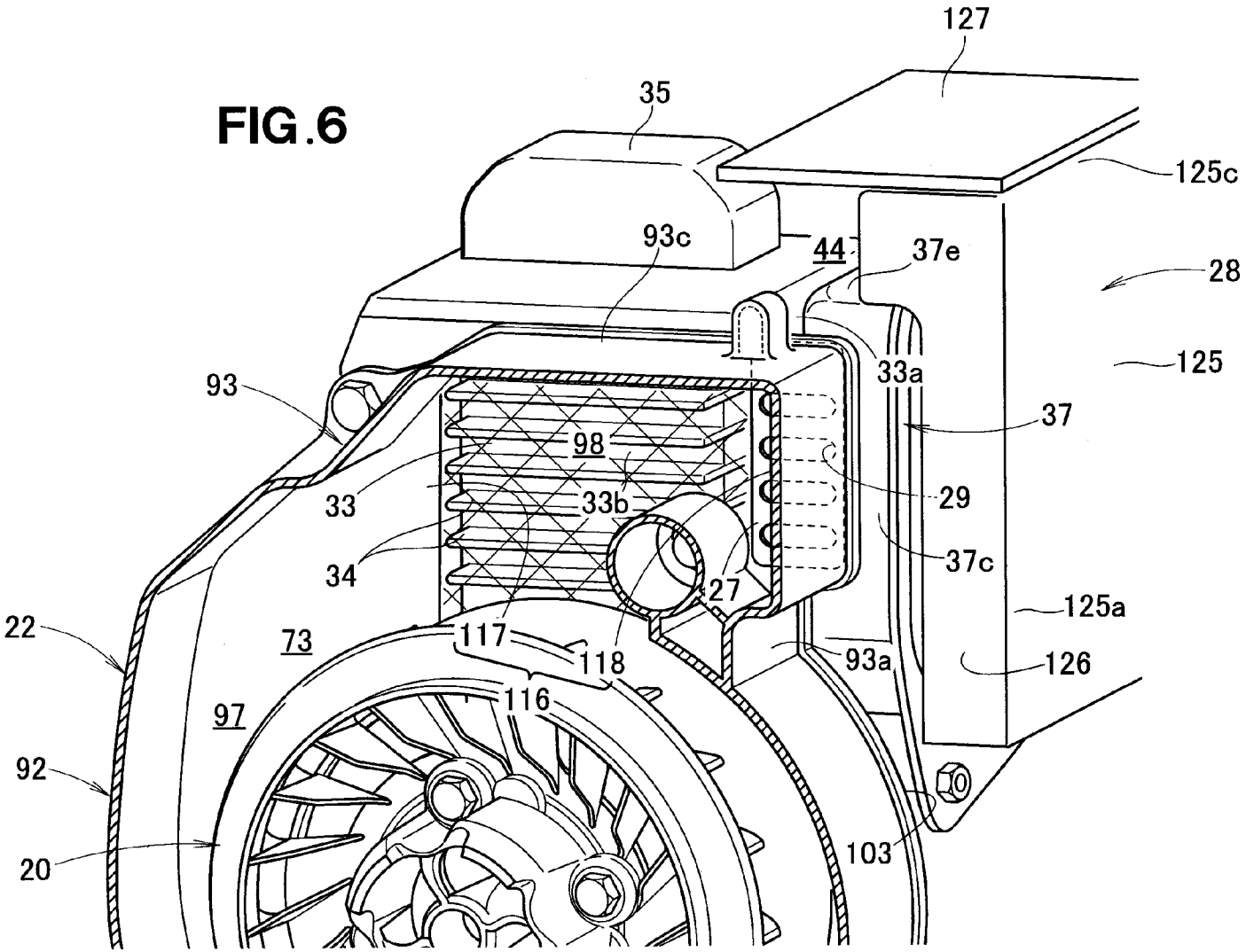
FIG. 6 is a perspective view of a shroud part shown in FIG. 1.

As shown in FIG. 6, the shroud part 93 has the air outlet 116 formed at the rear end 93*c* thereof. The air outlet 116 communicates with the rear end opening 103 of the cover part 92. The air outlet 116 includes a cylinder blow-off port 117 arranged to face a front surface 33*b* of the cylinder block 33, and a muffler blow-off port 118 arranged to face the front wall 37*c* of the exhaust muffler 37.

The cylinder blow-off port 117 has a substantially rectangular shape and is arranged to face, in a state of being adjacent to, the front surface 33*b* of the cylinder block 33. To facilitate easy understanding of the shape of the cylinder blow-off port 117, the cylinder blow-off port 117 is indicated by a mesh pattern. The muffler blow-off port 118 has a substantially rectangular shape and is arranged to face, in a state of being adjacent to, the front wall 37*c* of the exhaust muffler 37. The opening area-adjusting member 27 is provided on the entire area of the muffler blow-off port 118.

The shroud part 93 has a lower portion 93*a* connected to the upper portion 92*a* of the cover part 92 so that an internal space 98 of the shroud part 93 is in communication with the internal space 97 of the cover part 92. The internal space 98 of the shroud part 93 and the internal space 97 of the cover part 92 together form an internal space 73 of the fan cover 22.

As shown in FIG. 2, cooling air is guided from the front end opening 101 of the cover part 92 via the cooling fan 20 (more particularly, the centrifugal fan 53 thereof) to the internal space 97 of the cover part 92, and the thus guide cooling air is blown from the internal space 97 of the cover part 92 into the internal space 98 of the shroud part 93. The cooling air blown into the internal space 98 of the shroud part 93 is directly guide to the air outlet 116 (FIG. 6) through the shroud part 93.

Referring back to FIG. 6, the cooling air guided to the air outlet 116 is directly guided from the air outlet 116 to the front surface 33*b* of the cylinder block 33 and the front wall 37*c* of the exhaust muffler 37. The cooling air at a low temperature fed from the cooling fan 20 is thus directly guided to the front surface 33*b* of the cylinder block 33 and the front wall 37*c* of the exhaust muffler 37.

Figure 7:
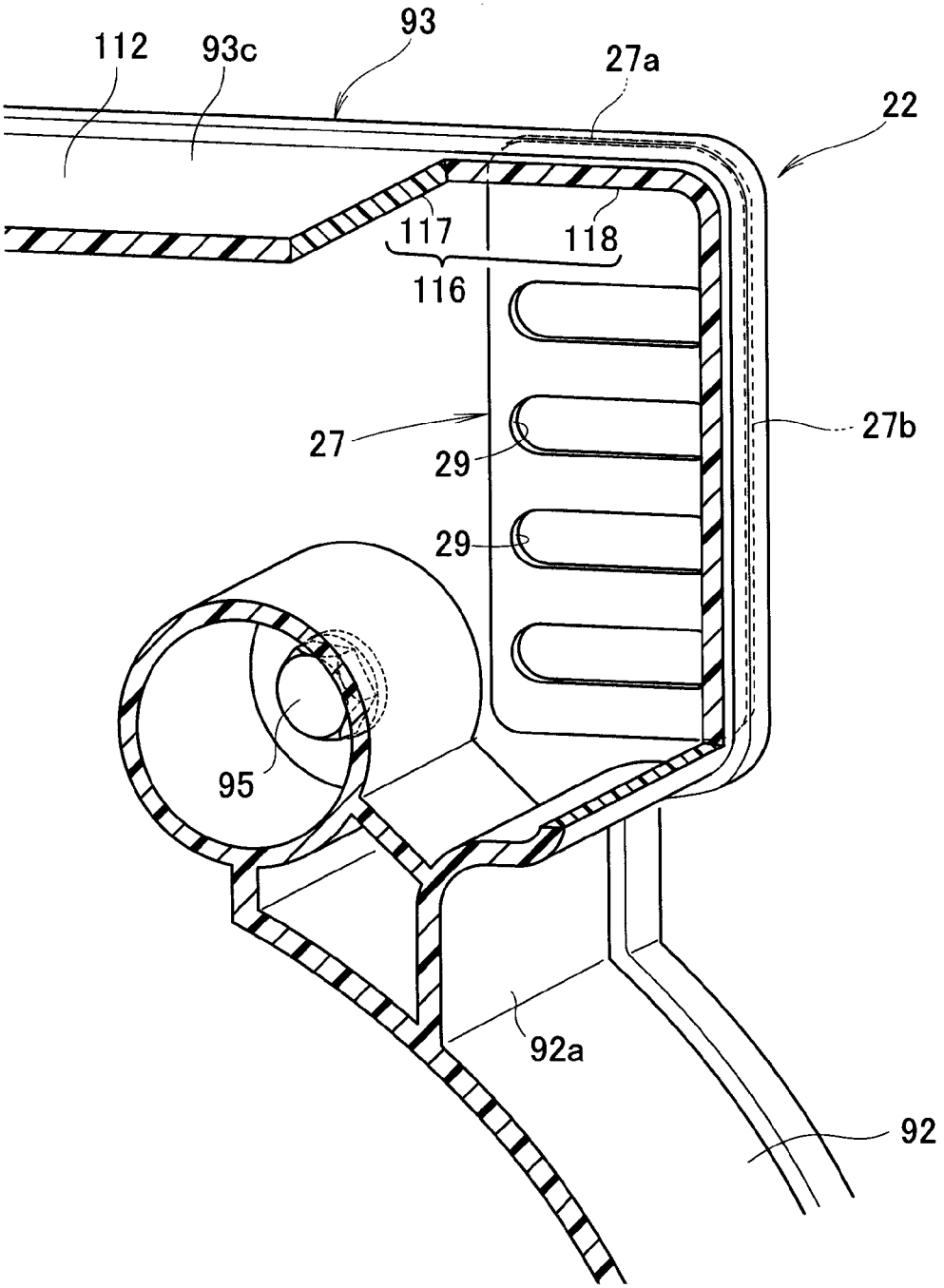
FIG. 7 is a perspective view of an open area-adjusting member shown in FIG. 6.

As shown in FIG. 7, the opening area-adjusting member 27 is provided on the entire area of the muffler blow-off port 118 of the air outlet 116. In other words, the muffler blow-off port 118 is covered by the opening area-adjusting member 27. The opening area-adjusting member 27 is made, for example, of a metal plate member formed into a substantially rectangular shape and has an upper edge 27*a* and an outer side edge 27*b* attached to the rear end 93*c* of the shroud part 93.

The opening area-adjusting member 27 has a plurality of openings 29 arranged at regular intervals in a vertical direction. The openings 29 are in the form of horizontally elongated holes. The plurality of openings 29 determines an opening area of the muffler blow-off port 118. The opening area of the muffler blow-off port 18 can be adjusted by varying the number and configuration of the openings 29. Merely by changing the configuration of the openings 29, it is possible to adjust the opening area of the muffler blow-off port 118.

As shown in FIG. 6, the shroud part 93 has the air outlet 116 (i.e., the cylinder blow-off port 117 and the muffler blow-off port 118) provided at the rear end 93*c* thereof. The low-temperature cooling air fed from the cooling fan 20 is directly guided onto the front surface 33*b* of the cylinder block 33 and the front wall 37*c* of the exhaust muffler 37. Furthermore, the muffler blow-off port 118 is provided with the opening area-adjusting member 27 so that the opening area of the muffler blow-off port 118 can be adjusted by the opening area-adjusting member 27. With this arrangement, a volume of cooling air guided to the front surface 33*b* of the cylinder block 33 and a volume of cooling air guided to the front wall 37*c* of the exhaust muffler 37 can be properly distributed by the opening area-adjusting member 27. The cylinder block 33 and the exhaust muffler 37 can thus be properly cooled by the cooling air fed from the cooling fan 20.

In a state where the exhaust muffler 37 is provided on the lateral side 33*a* of the cylinder block 33, the cylinder block 33 and the exhaust muffler 37 can be properly cooled by the cooling air fed from the cooling fan 20. It is therefore possible to perform downsizing of the engine-driven generator 10 while securing highly efficient cooling of the cylinder block 33 and the exhaust muffler 37.

As shown in FIG. 4, the muffler protector 28 is disposed on an outer side of the exhaust muffler 37. The muffler protector 28 includes a side wall 125 arranged along the outer wall 37*b* of the exhaust muffler 37, a front wall 126 bent inwardly from a front end 125*a* of the side wall 125, and a top plate 127 (FIG. 6) provided on an upper end of the side wall 125 and an upper end of the front wall 126.

The side wall 125 of the muffler protector 28 extends in a front-and-rear direction along the outer wall 37*b* of the exhaust muffler 37 and is disposed on an outer side of the outer wall 37*b* with a predetermined distance S1. In this condition, a rear end 125*b* of the side wall 125 is attached via a plurality of brackets 128 to the frame 11. The front wall 126 of the muffler protector 28 extends in a width direction along the front wall 37*c* of the exhaust muffler 37 and is disposed on a front side of the front wall 37*c* with a predetermined distance S2.

As shown in FIG. 6, the top plate 127 of the muffler protector 28 projects from an upper end 125*c* of the side wall 125 toward the head cover 35 in such a manner as to cover the top wall 37*e* of the exhaust muffler 37. The top plate 127 and the top wall 37*e* of the exhaust muffler 37 define therebetween an upper space 44.

The outer wall 37*b* of the exhaust muffler 37 is covered by the side wall 125 of the muffler protector 28 and the front wall 37*c* of the exhaust muffler 37 is covered by the front wall 126 of the muffler protector 28. Additionally, the top wall 37*e* of the exhaust muffler 37 is covered by the top plate 127 of the muffler protector 28. The exhaust muffler 37 can thus be protected by the muffler protector 28.

Referring back to FIG. 4, partly because the side wall 125 of the muffler protector 28 is separated from the outer wall 37*b* of the exhaust muffler 37 by the predetermined distance S1, and partly because the front wall 126 of the muffler protector 28 is separated from the front wall 37*c* of the exhaust muffler 37 by the predetermined distance S2, there is an air guide space 43 defined between the exhaust muffler 37 and the muffler protector 28.

The air guide space 43 has a front end portion 43*a* held in fluid communication with the openings 29 of the opening area-adjusting member 27. With this arrangement, the cooling air guided from the openings 29 onto the front wall 37*c* of the exhaust muffler 37 is further guided to the front end portion 43*c* of the air guide space 43. The cooling air thus guided to the front end portion 43*a* of the air guide space 43 is subsequently guided to flow downstream along the air guide space 43 to a rear end portion 43*b* of the air guide space 43.

Figure 8A:
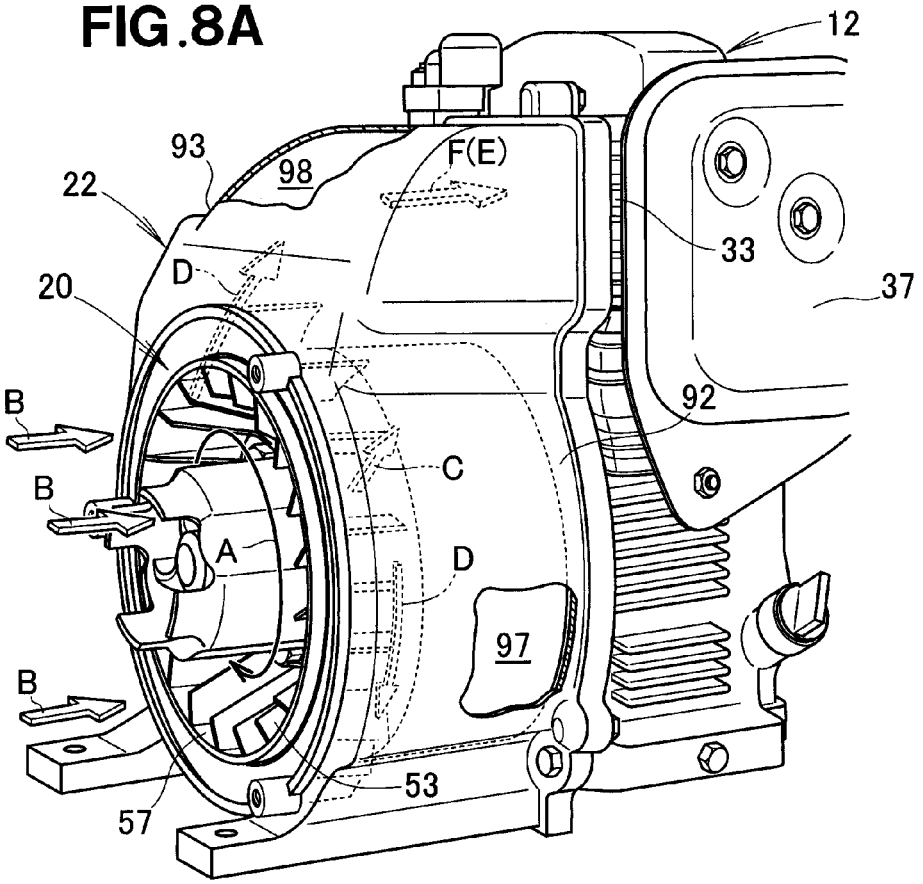
FIGS. 8A and 8B are views illustrative of the manner in which the engine is cooled by a cooling fan and the fan cover.

Referring next to FIGS. 8A and 8B and FIGS. 9A and 9B, a description will be made about the manner in which the engine 12 and the exhaust muffler 37 are cooled by the cooling fan 20 and the fan cover 22. The description will be first made, with reference to FIGS. 8A and 8B, about the manner in which the cylinder block 33 is cooled by the centrifugal fan 53 of the cooling fan 20. As shown in FIG. 8A, rotation of the cooling fan 20 in a direction of arrow A causes the centrifugal fan 53 to rotate in the direction of arrow A whereupon the outside air is sucked from an air inlet 57 of the cooling fan 20 into the centrifugal fan 53 as indicated by arrows B.

The air sucked from the air inlet 57 is guided by the centrifugal fan 53 in a radial outward direction of the cooling fan 20 as cooling air, as indicated by arrow C. The cooling air thus guided in the radial outward direction of the cooling fan 20 is forcibly fed from the outer circumference of the centrifugal fan 53 into the internal space 97 of the cover part 92. In this condition, since the centrifugal fan 53 is continuously rotating in the direction of arrow A, the cooling air fed into the internal space 97 of the cover part 92 is guided in a rotating direction of the centrifugal fan 53 along a peripheral wall of the cover part 92 toward the internal space 98 of the shroud part 93 as indicated by arrows D.

Figure 8B:
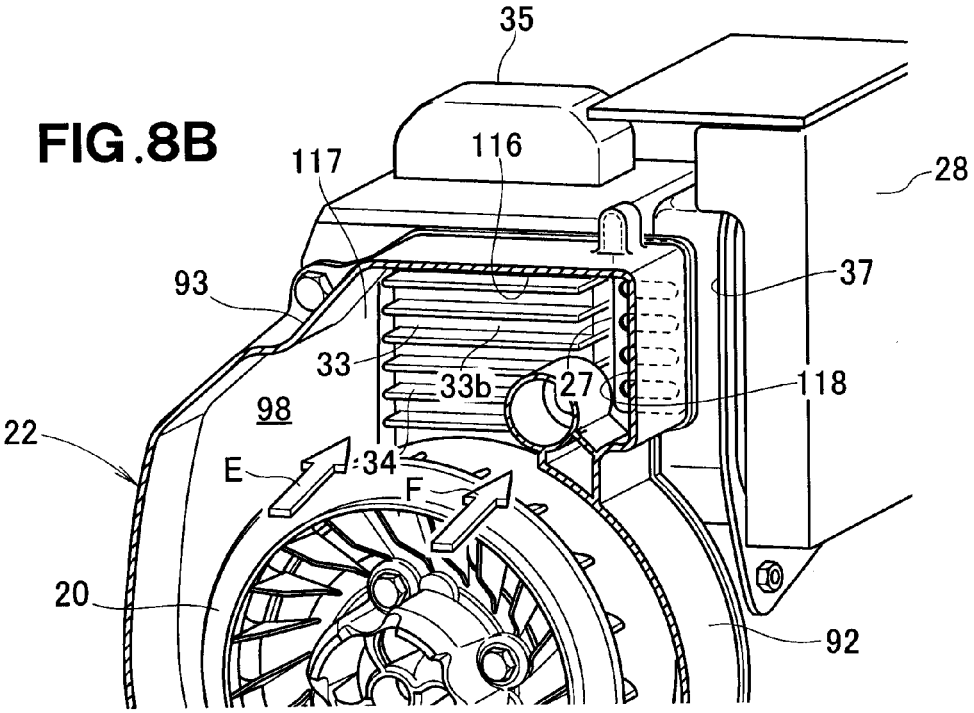

As shown in FIG. 8B, the cooling air guided into the internal space 98 of the shroud part 93 is partially guided along the shroud part 93 to the cylinder blow-off port 117 as indicated by arrow E. A remaining part of the cooling air guided into the internal space 98 of the shroud part 93 is guided along the shroud part 93 to the muffler blow-off port 118 (more specifically, the opening area-adjusting member 27) as indicated by arrow F. In this instance, because the muffler blow-off port 118 is provided with the opening area-adjusting member 27, the cooling air can be guided in a properly distributed condition to the cylinder blow-off port 117 and the opening area-adjusting member 27.

The cooling air distributed to the cylinder blow-off port 117 is guided via the cylinder blow-off port 117 toward the front surface 33*b* of the cylinder block 33. The cooling air can thus be guided onto the cooling fins 34 of the cylinder block 33. Low-temperature cooling air fed from the cooling fan 20 is directly guide to the front surface 33*b* of the cylinder block 33 so that the cylinder block 33 can be properly cooled by the low-temperature cooling air.

Figure 9A:
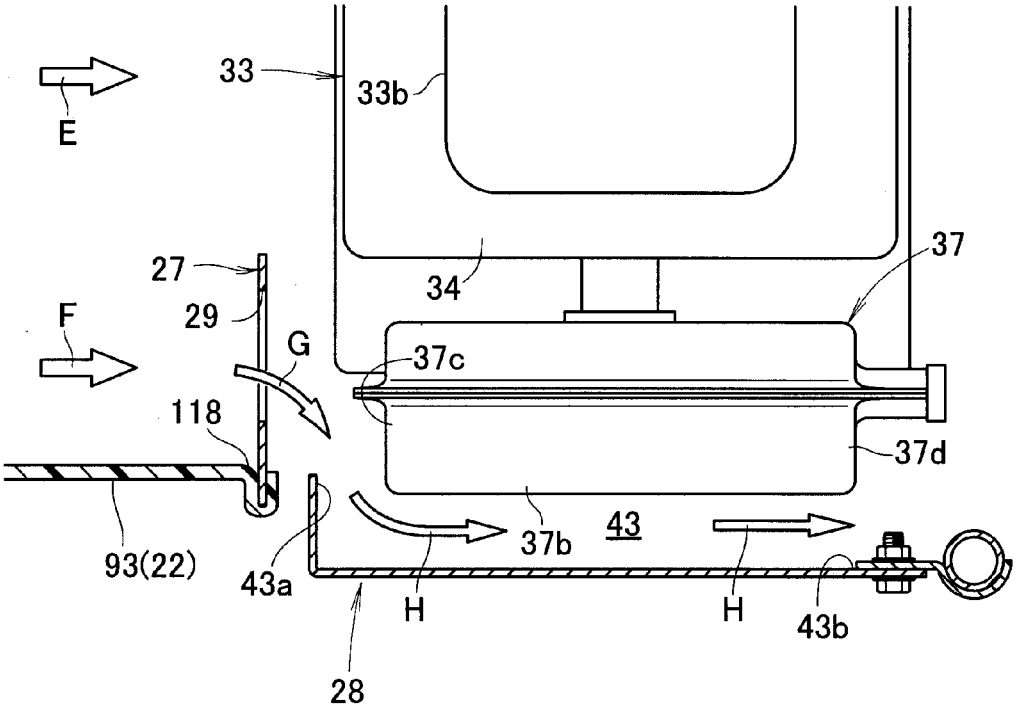
FIGS. 9A and 9B are views illustrative of the manner in which the exhaust muffler is cooled by the cooling fan and the fan cover.

As shown in FIG. 9A, the cooling air distributed to the opening area-adjusting member 27 is guided via the opening area-adjusting member 27 (more specifically, the openings 29 thereof) toward the front wall 37*c* of the exhaust muffler 37 as indicated by arrow G. The cooling air guided to the front wall 37*c* of the exhaust muffler 37 is subsequently guided to the front end portion 43*a* of the air guide space 43.

The cooling air guided to the front end portion 43*a* of the air guide space 43 is guided to flow downstream along the air guide space 43 to the rear end portion 43*b* of the air guide space 43 as indicated by arrows H. The cooling air, as it is guided along the air guide space 43, flows downstream along the front wall 37*c* and the outer wall 37*b* of the exhaust muffler 37. Low-temperature cooling air fed from the cooling fan 20 can thus be directly guided to the front wall 37*c* and the outer wall 37*b* of the exhaust muffler 37.

Figure 9B:
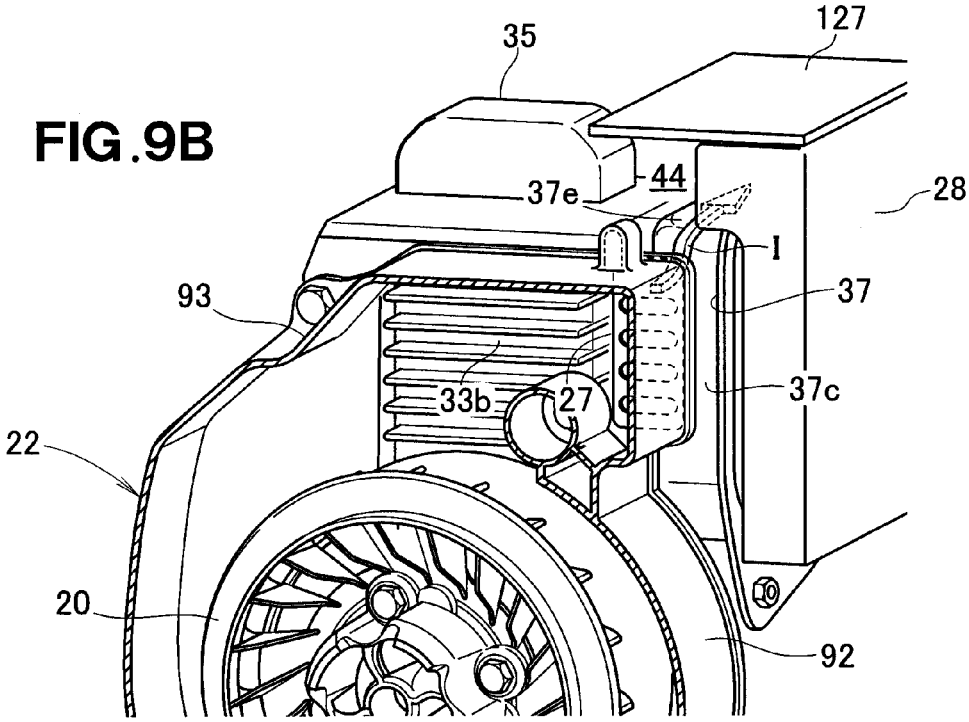

As shown in FIG. 9B, the upper space 44 is defined between the top plate 127 of the muffler protector 28 and the top wall 37*e* of the exhaust muffler 37. A part of the cooling air guided to the front wall 37*b* of the exhaust muffler 37 is guided into the upper space 44 as indicated by arrow I. The cooling air guided into the upper space 44 is further guided to flow rearward along the top wall 37*e* of the exhaust muffler 37. The low-temperature cooling air can thus be directly guided to the top wall 37*e* of the exhaust muffler 37.

As shown in FIGS. 9A and 9B, the low-temperature cooling air fed from the cooling fan 20 is directly guided to the front wall 37*c*, the outer wall 37*b* and the top wall 37*e* of the exhaust muffler 37, so that the exhaust muffler 37 can be properly cooled by the low-temperature cooling air.

The engine-driven generator according to the present invention should by no means be limited to the one shown the illustrated embodiment, but various changes and modifications thereof are possible. For example, in the illustrated embodiment, the openings 29 of the opening area-adjusting member 27 are in the form of horizontally elongated holes. The openings 29 may be formed into any other shape such as a circular shape.

Furthermore, the shape and configuration of the engine-driven generator, the engine, the crankshaft, the generator unit, the cooling fan, the fan cover, the opening area-adjusting member, the muffler protector, the openings, the cylinder block, the cylinder, the exhaust muffler, the air guide space, the air outlet, the cylinder blow-off port, and the muffler blow-off port can be changed as appropriate without being limited to those shown in the illustrated embodiment.

The present invention is particularly suitable for an application to an engine-driven generator including a generator unit driven by an engine, and an exhaust muffler provided in the vicinity of a cylinder block of the engine.

Obviously, various minor changes and modifications of the present invention are possible in the light of the above teaching. It is therefore to be understood that within the scope of the appended claims the invention may be practiced otherwise than as specifically described.

What is claimed is:

1. An engine-driven generator comprising:

a vertical engine having a cylinder disposed vertically with respect to a bottom portion of an engine frame;

a generator unit provided on a side of the engine from which a crankshaft of the engine projects outwardly, and having a stator and a rotor, the rotor being driven by the crankshaft;

a cooling fan disposed on a side of the generator unit opposite to the engine for cooling the engine and the generator unit;

an exhaust muffler included in the engine and disposed adjacent to a lateral side of the cylinder extending along the crankshaft;

a fan cover having an air outlet arranged to face the exhaust muffler and the cylinder, the fan cover being configured to guide cooling air from the cooling fan directly to the air outlet; and an opening area-adjusting member including a metal plate member in a rectangular shape provided on the entire area of a muffler blow-off port of the air outlet for adjusting an opening area of the muffler blow-off port, wherein the opening area-adjusting member comprises a plurality of openings variable in number and configuration to adjust the opening area of the muffler blow-off port.

2. The engine-driven generator according to claim 1, further comprising:

a muffler protector for protecting the exhaust muffler; and an air guide space defined between the muffler protector and the exhaust muffler and held in fluid communication with the muffler blow-off port.

* * * * *